United States Patent [19]

Sauer

[11] 4,017,815

[45] Apr. 12, 1977

[54] IMPULSE VOLTAGE DISTRIBUTION IMPROVING PARTIAL-TURN ELECTROSTATIC SHIELDS FOR DISC WINDINGS

[75] Inventor: George E. Sauer, Stockbridge, Mass.

[73] Assignee: General Electric Company

[22] Filed: Sept. 27, 1976

[21] Appl. No.: 727,299

[52] U.S. Cl. ..... 336/70; 336/84

[51] Int. Cl.[2] ..... H01F 15/04

[58] Field of Search ..... 336/69, 70, 84

[56] References Cited

UNITED STATES PATENTS

| | | | |
|---|---|---|---|
| 3,160,838 | 12/1964 | Bedil | 336/69 |
| 3,380,007 | 4/1968 | Alverson et al. | 336/70 |

*Primary Examiner*—Thomas J. Kozma
*Attorney, Agent, or Firm*—John J. Kelleher

[57] ABSTRACT

A disc wound winding formed of a plurality of spirally wound, disc coil sections and having series capacitance increasing electrostatic shields in less than all of said sections, incorporates partial-turn electrostatic shields in disc coil sections adjacent that portion of said winding not having electrostatic shields. With this arrangement, a substantial reduction in the change in series capacitance between the shielded and unshielded portions of a disc wound winding is effected which minimizes unsatisfactory impulse voltage build-up at the beginning of the unshielded portion of said winding.

6 Claims, 17 Drawing Figures

IMPULSE VOLTAGE DISTRIBUTION IMPROVING PARTIAL-TURN ELECTROSTATIC SHIELDS FOR DISC WINDINGS

BACKGROUND OF THE INVENTION

1. Field of the invention.

The present invention relates to inductive winding for electrical apparatus such as transformers, reactors and the like in general, and to spirally wound inductive windings of the continuous disc type having impulse voltage distribution improving electrostatic shields in less than all of its disc coil sections in particular.

2. Prior Art

It is well-known that highly inductive windings, such as in iron core transformers and reactors, when exposed to steep wave front impulse voltages, initially exhibit an exponential distribution of voltage drop along the length of the winding with a very high voltage gradient along its first few turns. This extremely non-uniform distribution of voltage is due primarily to the unavoidable distributed capacitance between each incremental part of the winding and adjacent grounded parts such as the core and casing structure associated with the winding. Such ground capacitance is referred to as "parallel" capacitance. Such a winding also possesses another type of distributed capacitance between turns and groups of turns, the sum of such capacitance being in series with winding terminal. This type of distributed capacitance is referred to as "series" capacitance. If series capacitance alone were present, voltage distribution throughout the winding would be substantially uniform and linear, as it would be also if inductance alone were present. Inasmuch as series and parallel distributed capacitances are inherent characteristics of a highly inductive winding, the voltage distribution of impulse voltages applied to such windings is an extremely important design consideration.

The two principal winding configurations used in power transformers of high voltage and current rating are the layer type formed as a cylindrical helix or group of concentric cylindrical helices, and the radial spiral or continuous disc type. In a continuous disc-type winding, each of a plurality of annular coils is wound in a radial spiral, the coils (i.e., radial spiral) being disposed in axial juxtaposition on a linear core and connected, electrically, in a series circuit relation.

It is also well-known that a layer-type winding has a more linear transient voltage distribution than does a continuous disc-type winding, because the series capacitance of a layer winding is large relative to its parallel capacitance. However, for some high voltage applications, the disc type winding is used in order to avoid a high voltage gradient (and consequent heavy insulation) between helical layers at normal operation voltages. Thus, medium and large power, high-voltage transformers often have low-voltage windings of the layer helical or disc types and high-voltage windings of the disc type. In such transformers, the low-voltage winding is commonly located immediately adjacent the core and is surrounded by the higher voltage disc wound winding. Relative to the high-voltage winding, the entire low-voltage winding is approximately at ground potential and the radial space between them, called the "main gap", is an essential design parameter. The radial dimension of the main gap is determined primarliy by two considerations. One is the maximum permissible voltage stress across the main gap at the low, powercircuit circuit frequency and the other is the voltage stress resulting from high-frequency impulse voltages. In practice, the latter consideration often controls the size of the main gap in disc-type transformer windings.

In disc windings with adjacent winding coils, or disc coil sections connected in a series circuit relation (i.e., a continuous disc winding), the non-linearity of coil-to-coil impulse voltage stress usually requires that the first several turns at the high-voltage end be provided with extra insulation. For reasons of economy and size it is desirable to be able to reduce the size of the main gap and to reduce the amount of insulation between disc coils and between coil turns. All of these results may be accomplished if the normally steep exponential inpulse voltage distribution, which particularly characterizes the continuous disc winding, can be favorably modified and brought closer to an ideal uniform linear distribution.

It is known that the transient voltage distribution between axially juxtaposed coils or groups of coils in a disc type winding may be improved by various expedients which increase series capacitance relative to parallel capacitance. One such expedient is to place one or more shielding conductors between coil turns of the disc coil sections of a winding, as illustrated in U.S. Pat. No. 2,905,911 to KURITA. It is also known that these shield conductors, or electrostatic shields, become less effective as the distance from the high potential end of a winding to the electrostatic shield, increases.

Placing electrostatic shields, of the just-mentioned type along the entire length of a disc wound winding is considered poor design practice because of cost and size considerations and such designs are usually avoided. While it is true that more electrostatic shields will, in fact, improve the transient response of a disc wound winding, there is a region in such a winding, which is some calculable distance from a high potential end of same, where a point of diminishing returns is reached. Providing additional electrostatic shields beyond this region of the winding will result in a degree of impulse voltage distribution improvement that is not justified by the penalty that must be paid to obtain this improvement in terms of increased winding size and cost. Normal design practice is to discontinue electrostatic shields beyond this calculable distance. However, discontinuing electrostatic shields other than at the end of a disc wound winding creates problems that would not be present if electrostatic shields were continued throughout its entire length.

If abrupt changes in series capacitance occur when going from that portion of a disc wound winding having electrostatic shields, hereinafter also designated the compensated portion, to that portion of the winding that does not have electrostatic shields, hereinafter also designated the uncompensated portion, this sudden change in series capacitance will result in an unsatifactory impulse voltage build-up at the beginning of the low series capacitance or uncompensated portion of the winding in a manner that is very similar to the unsatisfactory transient voltage build-up that would be present at the high voltage end of the winding if electrostatic shields were not incorporated therein. If possible, such abrupt changes in series capacitance of a disc wound winding should be minimized to, in turn, minimize said unsatisfactory impulse voltage build-up.

SUMMARY OF THE INVENTION

In accordance with the present invention, a disc wound winding formed of a plurality of spirally wound, disc coil sections incorporating series capacitance increasing electrostatic shields in less than all of said sections has, as an improvement therto, partial-turn electrostatic shields in disc coil sections adjacent that portion of said winding not having electrostatic shields. With such a shielding arrangement the change in series capacitance from the shielded or compensated portion of said winding to the unshielded or uncompensated portion of said winding is substantially less precipitous than in a winding that does not have such electrostatic shields. The partial-turn shielding arrangement of the present invention minimizes the unsatisfactory impulse voltage build-up in the unshielded or lower series capacitance portion of said winding adjacent the shielded portion of same.

DESCRIPTION OF THE PRIOR ART

Throughout the description of the prior art and the preferred embodiments to be described elsewhere herein, parts having the same numerals in different drawing figures are to be considered the same or equivalent.

Figure 1:
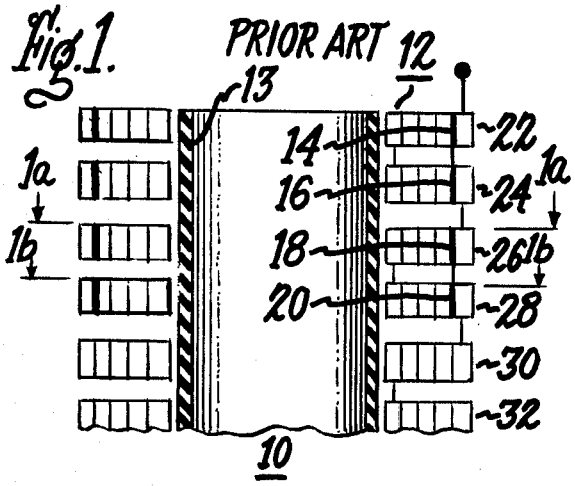
Fig. 1. PRIOR ART
FIG. 1 is a sectional view, in elevation, of a transformer having a disc wound winding incorporating electrostatic shields in accordance with the prior art.

Referring now to the drawings, and particularly to FIG. 1 wherein there is shown a sectional view, in elevation, of a portion of prior art transformer 10 that includes disc wound winding 12, wound on winding cylinder 13 incorporating single turn electrostatic shields 14, 16, 18 and 20 in disc coil sections 22, 24, 26 and 28, respectively. Disc wound winding 12 also includes disc coil sections 30 and 32 as well as additional disc coil sections (not shown) that are uncompensated or, in other words, do not incorporate electrostatic shields.

Figure 1A:
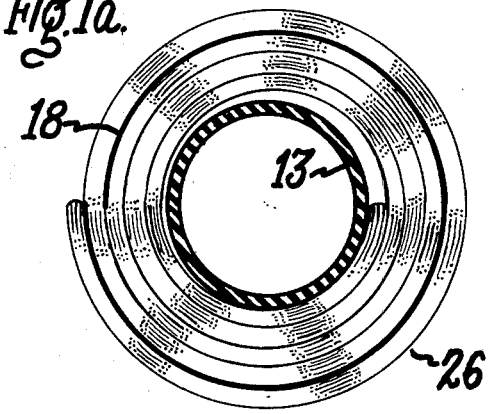
Fig. 1a. PRIOR ART
FIGS. 1*a* and 1*b* are cross sectional views taken on the lines 1*a*—1*a* and 1*b*—1*b* respectively, in FIG. 1.
Figure 1B:
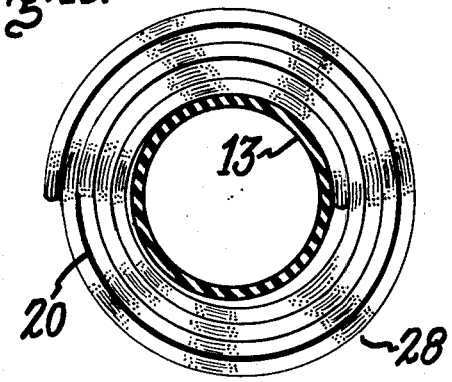
Fig. 1b. PRIOR ART

The disc coil sections of disc wound winding 12 are wound spirally inward and then spirally outward, beginning with an initial disc coil secton at one end of winding 12 and terminating with a final disc coil section at the opposite end of said winding 12, said disc coil sections being connected together in an electrical series circuit relation. Electrostatic shield conductors 14 and 16 in adjacent disc coil sections 22 and 24, respectively, are electrically connected together to form a shield conductor pair. Similarly, electrostatic shields 18 and 20 in adjacent disc coil sections 26 and 28, respectively, are also connected together to form a shield conductor pair. Shield conductors 14, 16, 18 and 20 are one complete turn in length and are located between the outermost turns in their respective disc coil sections. The length and placement of electrostatic shields 18 and 20 are more clearly illustrated in FIGS. 1*a* and 1*b*, respectively. In FIG. 1*a*, which is a cross sectional view taken on the line 1*a*—1*a* in FIG. 1, electrostatic shield 18 is located between the two outermost turns in disc coil section 26 and is one complete turn in length. In FIG. 1*b*, which is a cross sectional view taken on the line 1*b*—1*b* in FIG. 1, electrostatic shield 20 is located between the two outermost turns in disc coil section 28, and is also one complete turn in length.

DESCRIPTION OF THE PREFERRED EMBODIMENTS

Figure 2:
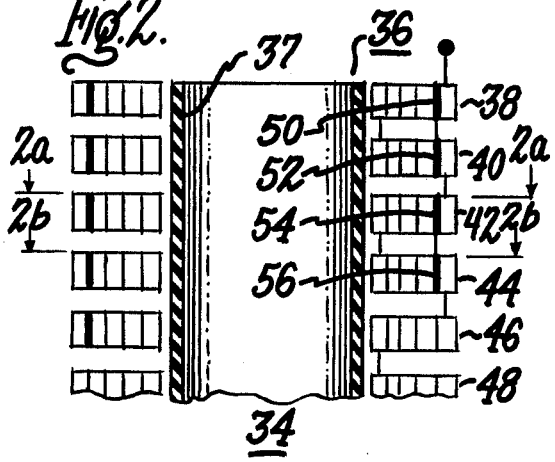
FIG. 2 is a sectional view, in elevation, of a transformer having a disc wound winding incorporating one-half turn electrostatic shield in accordance with the present invention.

Turning now to FIG. 2, where there is shown a portion of transformer 34 which includes disc wound winding 36, wound on winding cylinder 37, that incorporates impulse distribution improving, electrostatic shields that are constructed in accordance with a preferred embodiment of the present invention.

Winding 36 includes spirally wound disc coil sections 38, 40, 42, 44, 46, 48 and additional disc coil sections that have not been illustrated. These disc coil sections are spirally wound inward and then spirally outward beginning with a initial disc coil section at one end of winding 36 and terminating with a final disc coil section at the opposite end of said winding 36, said disc coil sections being connected together in an electrical series circuit relation. Disc coil sections 38 and 40 incorporate single turn electrostatic shields 50 and 52 respectively, and are connected together to form a shield conductor pair. Disc coil sections 46 and 48 and the remaining disc coil sections of winding 36 not depicted in FIG. 2, do not have electrostatic shields. Disc coil sections 42 and 44 incorporate one-half turn electrostatic shields 54 and 56, respectively, between their two outermost turns. The length and placement of shields 54 and 56 are more clearly illustrated in FIGS. 2*a* and 2*b*.

Figure 2A:
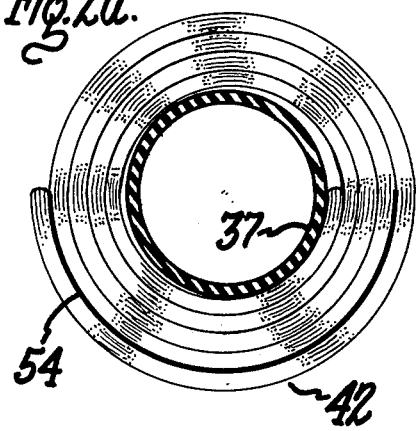
FIGS. 2*a* and 2*b* are cross sectional views taken on the lines 2*a*—2*a* and 2*b*—2*b*, respectively in FIG. 2.
Figure 2B:
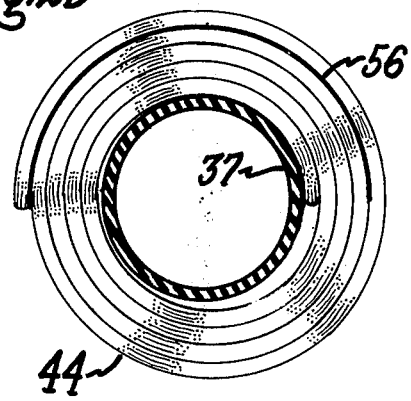

In FIG. 2*a*, which is a cross sectional view taken on the line 2a-2a in FIG. 2 electrostatic shield 54 is shown positioned between the two outermost turns of disc coil section 42 and is one-half turn in length. Similarly, in FIG. 2*b*, which is a cross sectional view taken on the line 2*b*—2*b*, in FIG. 2, electrostatic shield 56 is shown positioned between the two outermost turns of disc coil section 44 and is also one-half turn in length. Shields 54 and 56 are electricaly connected together to form a shield conductor pair.

Figure 3:
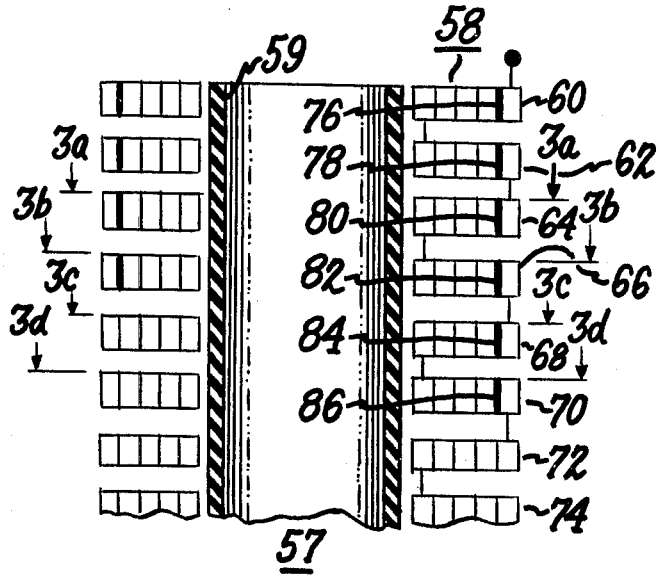
FIG. 3 is a sectional view, in elevation, of a transformer having a disc wound winding incorporating three-quarter and one-quarter turn electrostatic shields in accordance with the present invention.

FIG. 3, which is a sectional view, in elevation, of a portion of transformer 57, depicts disc wound winding 58 wound on winding cylinder 59. Winding 58 includes spirally wound disc coil sections 60, 62, 64, 66, 68, 70, 72, 74 and additional disc coil sections that have not been illustrated. These disc coil sections are wound spirally inward and then spirally outward beginning with an initial disc coil section at one end of winding 58, and terminating with a final disc coil section at the opposite end of said winding 58, said disc coil sections being connected together in an electircal series circuit relation. Disc coil sections 60 and 62 incorporate single turn electrostatic shields 76 and 78, respectively, and are connected together to form a shield conductor pair. Disc coil sections 72 and 74 and the remaining disc coil sections not depicted in FIG. 3 do not have electrostatic shields. Disc coil sections 64 and 66 incorporate three-quarter turn electrostatic sheilds 80 and 82, respectively, between their two outermost turns. Disc coil sections 68 and 70 incorporate one-guarter turn electrostatic shields 84 and 86, respectively, between their two outermost turns. The length and placement of shields 80, 82, 84 and 86 are more clearly illustrated in FIGS. 3*a*, 3*b*, 3*c* and 3*d*.

Figure 3A:
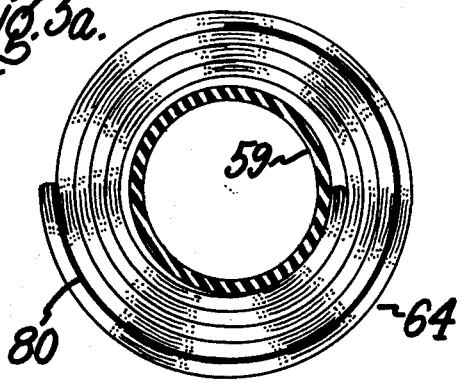
FIGS. 3*a*, 3*b*, 3*c* and 3*d* are cross sectional views taken on the lines 3*a*—3*a*, 3*b*—3*b*, 3*c*—3*c* and 3*d*—3*d*, respectively, in FIG. 3.

In FIG. 3*a*, which is a cross sectional view taken on the line 3*a*—3*a* in FIG. 3, electrostatic shield 80 is shown positioned between the two outermost turns of disc coil section 64 and is three-quarter turn in length. Similarly, in FIG. 3*b* which is a cross sectional view taken on the line 3*b*—3*b* in FIG. 3, electrostatic shield 82 is shown positioned between the two outermost turns of disc coil secton 66 and is three-quarter turn in length. Shields 80 and 82 are electically connected together to form a shield conductor pair.

Figure 3C:
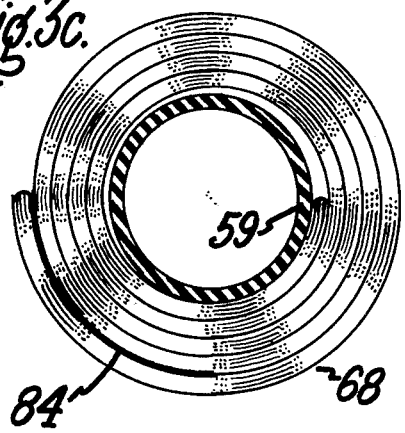
Figure 3B:
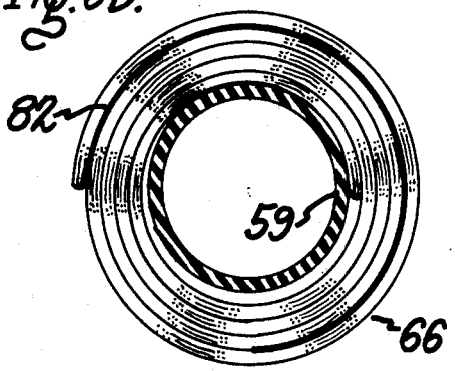
Figure 3D:
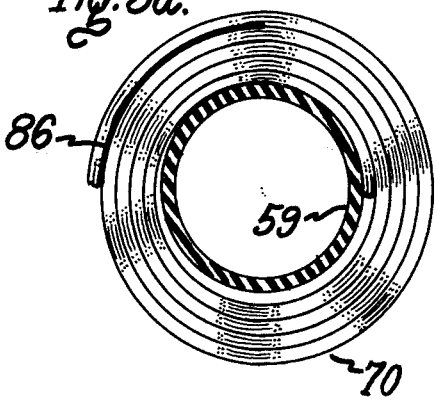

In FIG. 3*c*, which is a cross sectional view taken on the line 3*c*—3*c* in FIG. 3, electrostatic shield 84 is shown positioned between the two outermost turns of disc coil section 68 and is one-quarter turn in length. Similarly, in FIG. 3*d*, which is a cross sectional view taken on the line 3*d*—3*d* in FIG. 3, electrostatic shield 86 is shown positioned between the two outermost turns of disc coil section 70 and is also one-quarter turn in length. Shields 84 and 86 are electrically connected together to form a shield conductor pair.

Figure 4:
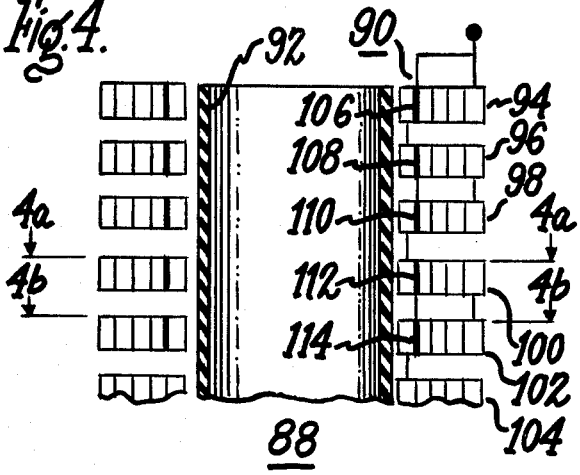
FIG. 4 is a sectional view, in elevation, of a portion of a transformer having a disc wound winding incorporating inner one-half turn electrostatic shields in accordance with the present invention.

FIG. 4, which is a sectional view, in elevation, of a portion of transformer 88, depicts disc wound winding 90 wound on winding cylinder 92. Winding 90 includes spirally wound disc coil sections 94, 96, 98, 100, 102, 104 and additional disc coil sections that have not been illustrated. These disc coil sections are wound spirally inward and then spirally outward beginning with an initial disc coil section at one end of disc winding 90 and terminating with a final disc coil section at the opposite end of said winding 90, said disc coil sections being connected together in an electrical series circuit relation. Disc coil section 94 incorporates single turn electrostatic shield 106. Electrostatic shield 106 is located between the two innermost turns of disc coil section 94 and is connected to a winding 90 power input terminal. Disc coil sections 96 and 98 incorporate single turn electrostatic shields 108 and 110 between the two innermost turns of their respective disc coil sections and are electrically connected together to form a shield conductor pair. Disc coil section 104 and the remaining disc coil sections of winding 90 not depicted in FIG. 4, do not have electrostatic shields. Disc coil sections 100 and 102 incorporate one-half turn electrostatic shields 112 and 114, respectively, between their two innermost turns. The length and placement of shields 112 and 114 is more clearly illustrated in FIGS. 4*a* and 4*b*.

Figure 4A:
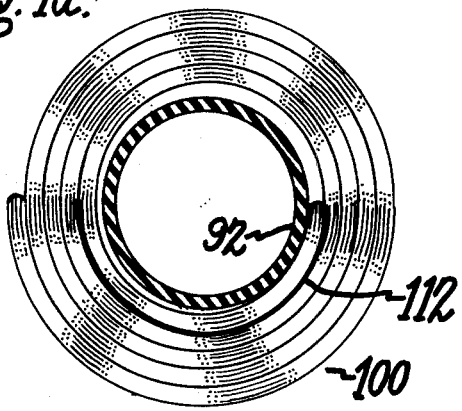
FIGS. 4*a* and 4*b* are cross sectional views taken on the lines 4*a*—4*a* and 4*b*—4*b*, respectively, in FIG. 4.
Figure 4B:
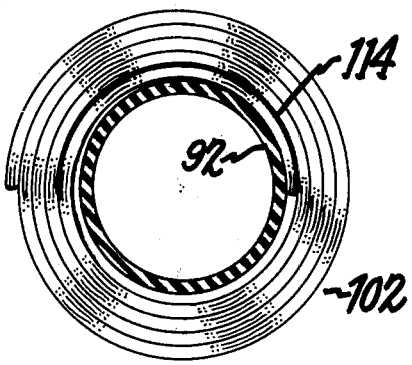

In FIG. 4*a*, which is a cross sectional view taken on the line 4*a*—4*a* in FIG. 4, electrostatic shield 112 is shown positioned between the innermost turns of disc coil section 100 and is one-half turn in length. Similarly, in FIG. 4*b*, which is a cross-sectional view taken on the line 4*b*—4*b*, in FIG. 4, electrostatic shield 114 is shown positioned between the two innermost turns of disc coil section 102 and is also one-half turn in length. Shields 112 and 114 are electrically connected together to form a shield conductor pair.

Figure 5:
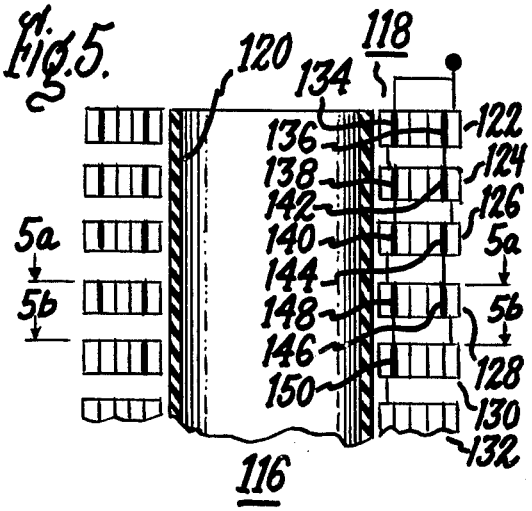
FIG. 5 is a sectional view, in elevation, of a portion of a transformer having a disc wound winding incorporating inner and outer electrostatic shields and inner one-half turn electrostatic shields in accordance with the present invention.

FIG. 5, which is a sectional view, in elevation, of a portion of transformer 116, depicts disc wound winding 118 wound on winding cylinder 120. Winding 118 includes spirally wound disc coil sections 122, 124, 126, 128, 130, 132 and additional disc coil sections that have not been illustrated. These disc coil sections are wound spirally inward and then sprially outward beginning with an initial disc coil section at one end of winding 118 and terminating with a final disc coil section at the opposite end of said winding 118, said discs coil sections being connected together in an electrical series circuit relation. Disc coil section 122 incorporates single turn electrostatic shields 134 and 136 between its innermost and outermost turns, respectively. Sheild 134 is connected to a winding 118 power input terminal. Disc coil sections 124 and 126 incorporate single turn electrostatic shields 138 and 140 between their two innermost turns, respectively. Disc coil sections 124 and 126 also incorporate single turn electrostatic shield 142 and 144 between their two outermost turns, respectively. Shield conductors 136 and 142 are electrically connected together to form a shield conductor pair. Shield conductor 138 and 140 are also electrically connected together to form a shield conductor pair. Disc coil section 132 and the remaining disc coil sections of winding 118 that are not depicted in FIG. 5 do not have electrostatic shields. Disc coil section 128 incorporates single turn electrostatic shield 146 between its two outermost turns and one-half turn electrostatic shield 148 between its two innermost turns. Disc coil section 130 incorporates one-half turn electrostatic shield 150 between its two innermost turns. Shield conductors 144 and 146 are electrically connected together to form a shield conductor pair. The length and placement of shields 146, 148 and 150 are more clearly illustrated in FIGS. 5*a* and 5*b*.

Figure 5A:
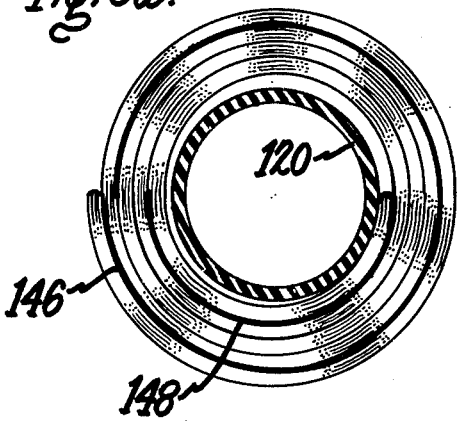
FIGS. 5*a* and 5*b* are cross sectional views taken on the lines 5*a*—5*a* and 5*b*—5*b*, respectively, in FIG. 5.

In FIG. 5*a*, which is a cross sectional view taken on the line 5*a*—5*a* in FIG. 5, electrostatic shield 146 is shown positioned between the two outermost turns of disc coil section 128 and is a full turn in length. Also, electrostatic shield 148 is shown positioned between the two innermost turns of disc coil section 128 and is one-half turn in length.

Figure 5B:
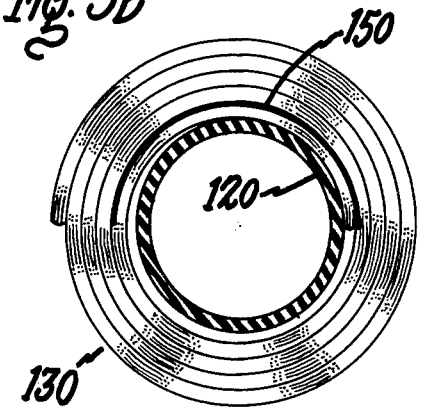

In FIG. 5*b*, which is a cross sectional view taken on the line 5*b*—5*b* in FIG. 5, electrostatic shield 150 is shown positioned between the two innermost turns of disc coil section 130 and is one-half turn in length. Shield conductors 148 and 150 are elecrically connected together to form a shield conductor pair.

DISCUSSION

Shield conductors 14, 16, 18 and 20 in winding 12 of prior art transformer 10 increase the series capacitance and thereby improve the impulse voltage distrubution of the disc coil sections in which they are located. However, as previously explained electrostatic shields of this type are not normally included in all of the disc coil sections of a disc wound winding.

An impulse voltage applied to a winding such as winding 12 to transformer 10 sees a sudden change in winding series capacitance from the shielded or compensated portion of winding 12 to the unshielded or uncompensated portion of said winding 12. This sudden change in series capacitance results in an unsatifactory impulse voltage build-up in those disc coil sections of the uncompensated portion of the winding that are adjacent the electrostatic shield containing portion of said winding. This impusle voltage build-up is very similar to that which would be present at a high voltage end of winding 12 if electrostatic shields 14, 16, 18 and 20 were not incorporated therein. The greater the difference in series capacitance between the compensated and uncompensated portions of winding 12 the greater will be the unsatisfactory impulse voltage build-up in the just-defined region of the uncompensated portion of said winding.

The present invention minimizes this just-memtioned impulse voltage build-up in those disc coil sections of the uncompensated portion of the winding that are adjacent the compensated portion of said winding. This result is achieved by adding less series capacitance to those disc coil sections adjacent the low series capacitance or uncompensated portion of a disc wound winding than was added to other winding disc coil sections.

Winding 36 of transformer 34 has one-half turn electrostatic shields in disc coil sections 42 and 44 which adds only one-half the amount of series capacitance to these disc coil sections of that added to other compensated disc coil sections of said winding 36. By comparison, the change in series capacitance from the compensated to the uncompensated portion of winding 36 is one-half that of equivalent region of winding 12 in prior art transformer 10.

Winding 58 of transfomer 57 has three-quarter turn electrostatic shields in disc coil sections 64 and 66 which add three-quarters of the amount of series capacitance to these disc coil sections of that added to other disc coil sections of said winding 58 having greater added compensation. Disc coil sections 68 and 70 in winding 58 have one-quarter turn electrostatic shield which add only one-guarter of the amount of series capacitance to these disc coil sections of that added to disc coil sections by full turn electrostatic shields. The change in added series capacitance from the compensated to the uncompensated portions of winding 58 is more gradual than that of winding 36 and is only one-guarter that of winding 12 prior art transformer 10.

The change in added series capacitance from the compensated to uncompensated portions of windings 90 and 118 in FIGS. 4 and 5, respectively, is the same as in winding 36 in FIG. 2. The major difference between these two windings is the placement and number of electrostatic shields and not the length of the partial turn electrostatic shields adjacent the uncompensated portion of their respective windings.

It will be apparent to those skilled in the art from the foregoing description of the present invention that various improvments and modifications can be made without departing from its true scope. Accordingly, it is my intention to encompass within the scope of the claims appended hereto, the true limits and spirit of my invention.

1. Improved electrostatic shielding for inductive apparatus of the type having, a winding, including a plurality of generally coaxially disposed annular disc coil sections, each of said coil sections having a plurality of insulated conductor turns, each of said conductor turns having at least one strand;

spirally wound, in the same direction, alternately radially inward and radially outward, a finish-end of a disc coil section being connected to a start-end of an immediately adjacent disc coil section for form a winding connected in an electrical series circuit relation, electrostatic shield conductors in less than all of said disc coil sections forming a winding having a portion with, and a portion without electrostatic shield conductors, a shield conductor in one disc coil section being electrically connected to a correspondingly positioned shield conductor in an immediatley adjacent disc coil section to form a shield conductor pair, wherein the improvement comprises:

partial-turn electrostatic shield conductors in at least a disc coil section pair between those disc coil sections of said winding having, and those disc coil sections of said winding not having electrostatic shield conductors, said partial-turn electrostatic shields being connected together to form shield conductor pairs.

2. Improved electrostatic shielding for inductive apparatus, as defined in claim 1, wherein said electrostatic shield conductors in said disc coil section pair between the shielded and unshielded portions of said winding are one-half turn in length.

3. Improved electrostatic shielding for inductive apparatus, as defined in claim 1, wherein said electrostatic shield conductors in said disc coil section pair between the shielded and unshielded portion of said winding are one-quarter turn in length, and the electrostatic shields in the disc coil section pair immediately adjacent said disc coil sections having one-quarter turn length electrostatic shield conductors, have electrostatic shield conductors that are three-quarter turn in length.

4. Improved electrostatic shielding for inductive apparatus, as defined in claim 1, wherein said electrostatic shield conductors are located between the outermost turns only, of said disc coil sections.

5. Improved electrostatic shielding for inductive apparatus, as defined in claim 1, wherein said electrostatic shield conductors are located between the innermost turns only, of said disc coil sections.

6. Improved electrostatic shielding for inductive apparatus, as defined in claim 1, wherein said electrostatic shield conductors are located between the outermost and the innermost turns only, of said disc coil sections.

* * * * *

UNITED STATES PATENT OFFICE

CERTIFICATE OF CORRECTION

Patent No. 4,017,815 Dated April 12, 1977

Inventor(s) George E. Sauer

It is certified that error appears in the above-identified patent and that said Letters Patent are hereby corrected as shown below:

Col. 4, line 42, "a" should -- an --.
Col. 7, line 4, "to" should be -- of --.
Col. 7, line 21, "memtioned" should be -- mentioned --.
Col. 7, line 51, after "12" insert -- in --.
Col. 8, line 16, "for" should be -- to --.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*